US006340334B1

(12) United States Patent
Olsen et al.

(10) Patent No.: US 6,340,334 B1
(45) Date of Patent: Jan. 22, 2002

(54) PORTABLE FIGHT RING

(76) Inventors: Jeff P. Olsen; Joseph Gambino, both of 857 W. 28th, San Pedro, CA (US) 90731

( * ) Notice: Subject to any disclaimer, the term of this patent is extended or adjusted under 35 U.S.C. 154(b) by 0 days.

(21) Appl. No.: 09/714,926

(22) Filed: Nov. 17, 2000

(51) Int. Cl.[7] ..... A63C 19/00
(52) U.S. Cl. ..... 472/93; 472/92; 52/299
(58) Field of Search ..... 472/92, 93, 94, 472/88, 89, 90, 136; 52/299, 292; 256/46, 47, 52, 1

(56) References Cited

U.S. PATENT DOCUMENTS 485,896 A * 11/1892 Sterry, Jr. ..... 472/93
1,753,328 A 4/1930 Barnes
2,119,327 A * 5/1938 Gunnarson ..... 472/93
2,243,943 A 6/1941 Bunting
2,267,865 A 12/1941 Hurley
2,726,866 A * 12/1955 Nally ..... 472/93
3,876,197 A 4/1975 Jenson
D254,202 S 2/1980 Kasas et al.
5,087,030 A * 2/1992 Jones ..... 472/90
5,182,824 A 2/1993 Cipriano

* cited by examiner

*Primary Examiner*—Kien T. Nguyen

(57) ABSTRACT

A portable fight ring for allowing users to quickly assemble their own fighting rings in their own back yard. The portable fight ring includes a base assembly; and also includes a deck assembly being removably mounted upon the base assembly; and further includes rope support members including posts extending upwardly from said deck assembly for removably interlocking said base assembly; and also includes rope members being extended between the posts and along a perimeter of the deck assembly.

19 Claims, 3 Drawing Sheets

27
22
26
25
24
26
25
26
25
27
21
20
17
16
17
23
17
16
13
16

PORTABLE FIGHT RING

BACKGROUND OF THE INVENTION

1. Field of the Invention

The present invention relates to a portable wrestling ring and more particularly pertains to a new portable fight ring for allowing users to quickly assemble their own fighting rings in their own back yard.

2. Description of the Prior Art

The use of a portable wrestling ring is known in the prior art. More specifically, a portable wrestling ring heretofore devised and utilized are known to consist basically of familiar expected and obvious structural configurations, notwithstanding the myriad of designs encompassed by the crowded prior art which have been developed for the fulfillment of countless objectives and requirements.

Known prior art includes U.S. Pat. No. 1,753,328; U.S. Pat. No. 2,267,865; U.S. Pat. No. 2,243,943; U.S. Pat. No. 3,876,197; U.S. Pat. No. 5,182,824; and U.S. Pat. No. Des. 254,202.

While these devices fulfill their respective, particular objectives and requirements, the aforementioned patents do not disclose a new portable fight ring. The inventive device includes a base assembly; and also includes a deck assembly being removably mounted upon the base assembly; and further includes rope support members including posts extending upwardly from said deck assembly for removably interlocking said base assembly; and also includes rope members being extended between the posts and along a perimeter of the deck assembly.

In these respects, the portable fight ring according to the present invention substantially departs from the conventional concepts and designs of the prior art, and in so doing provides an apparatus primarily developed for the purpose of allowing users to quickly assemble their own fighting rings in their own back yard.

SUMMARY OF THE INVENTION

In view of the foregoing disadvantages inherent in the known types of portable wrestling ring now present in the prior art, the present invention provides a new portable fight ring construction wherein the same can be utilized for allowing users to quickly assemble their own fighting rings in their own back yard.

The general purpose of the present invention, which will be described subsequently in greater detail, is to provide a new portable fight ring which has many of the advantages of the portable wrestling ring mentioned heretofore and many novel features that result in a new portable fight ring which is not anticipated, rendered obvious, suggested, or even implied by any of the prior art portable wrestling ring, either alone or in any combination thereof.

To attain this, the present invention generally comprises a base assembly; and also includes a deck assembly being removably mounted upon the base assembly; and further includes rope support members including posts extending upwardly from said deck assembly for removably interlocking said base assembly; and also includes rope members being extended between the posts and along a perimeter of the deck assembly.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new portable fight ring which has many of the advantages of the portable wrestling ring mentioned heretofore and many novel features that result in a new portable fight ring which is not anticipated, rendered obvious, suggested, or even implied by any of the prior art portable wrestling ring, either alone or in any combination thereof.

It is another object of the present invention to provide a new portable fight ring which may be easily and efficiently manufactured and marketed.

It is a further object of the present invention to provide a new portable fight ring which is of a durable and reliable construction.

An even further object of the present invention is to provide a new portable fight ring which is susceptible of a low cost of manufacture with regard to both materials and labor, and which accordingly is then susceptible of low prices of sale to the consuming public, thereby making such portable fight ring economically available to the buying public.

Still yet another object of the present invention is to provide a new portable fight ring which provides in the apparatuses and methods of the prior art some of the advantages thereof, while simultaneously overcoming some of the disadvantages normally associated therewith.

Still another object of the present invention is to provide a new portable fight ring for allowing users to quickly assemble their own fighting rings in their own back yard.

Yet another object of the present invention is to provide a new portable fight ring which includes a base assembly; and also includes a deck assembly being removably mounted upon the base assembly; and further includes rope support members including posts extending upwardly from said deck assembly for removably interlocking said base assembly; and also includes rope members being extended between the posts and along a perimeter of the deck assembly.

Still yet another object of the present invention is to provide a new portable fight ring that allows users to imitate their favorite professional wrestling star.

Even still another object of the present invention is to provide a new portable fight ring that can be easily, quickly and conveniently put together.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
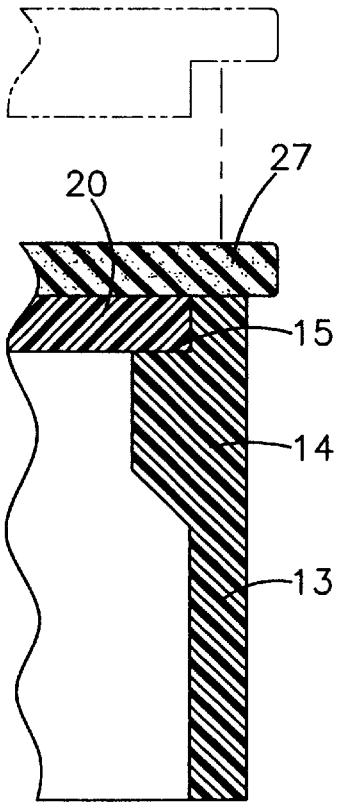
FIG. 2 is a cross-sectional view of a corner of the deck and base of the present invention.
Figure 1:
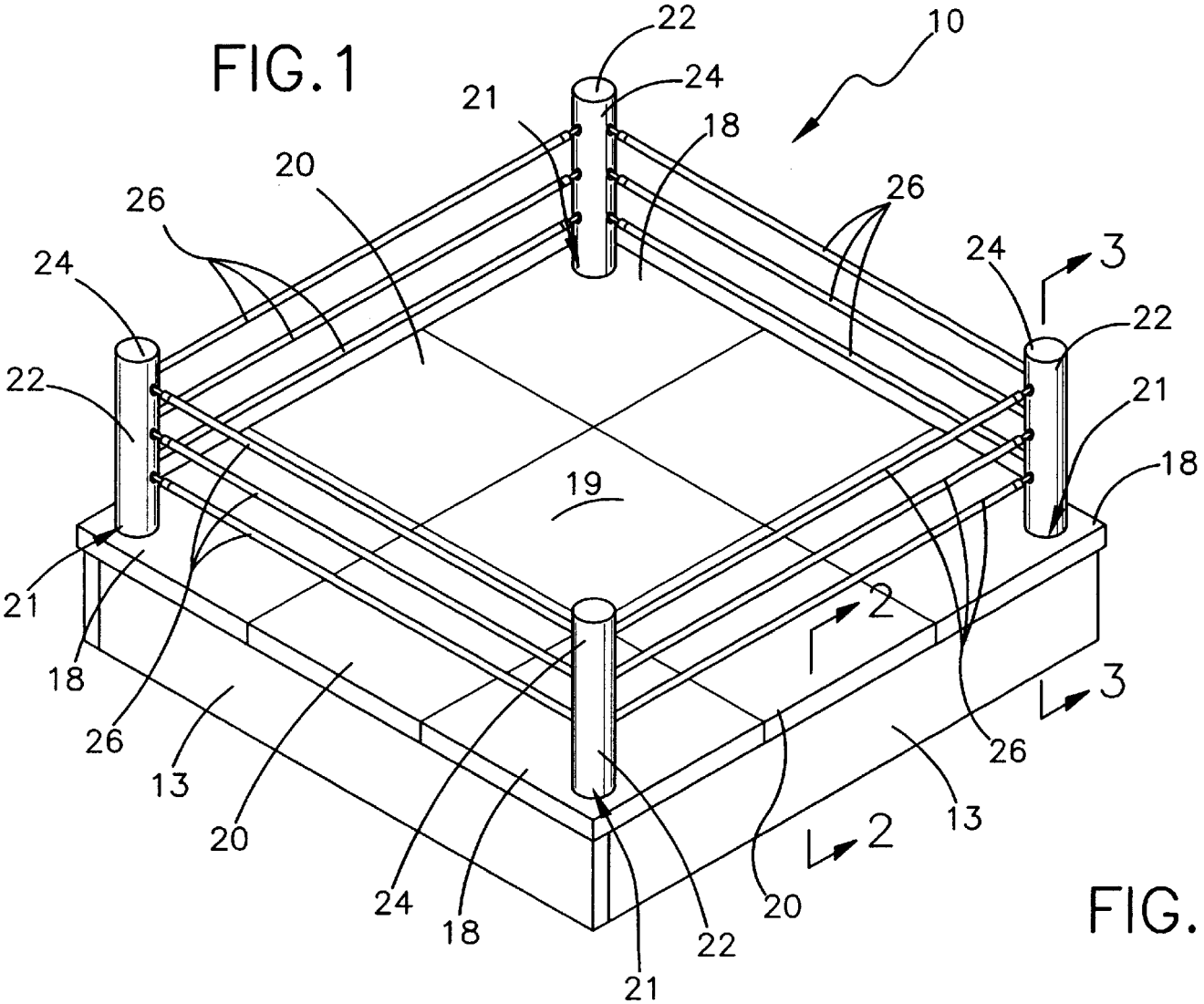
FIG. 1 is a perspective view of a new portable fight ring according to the present invention.
Figure 3:
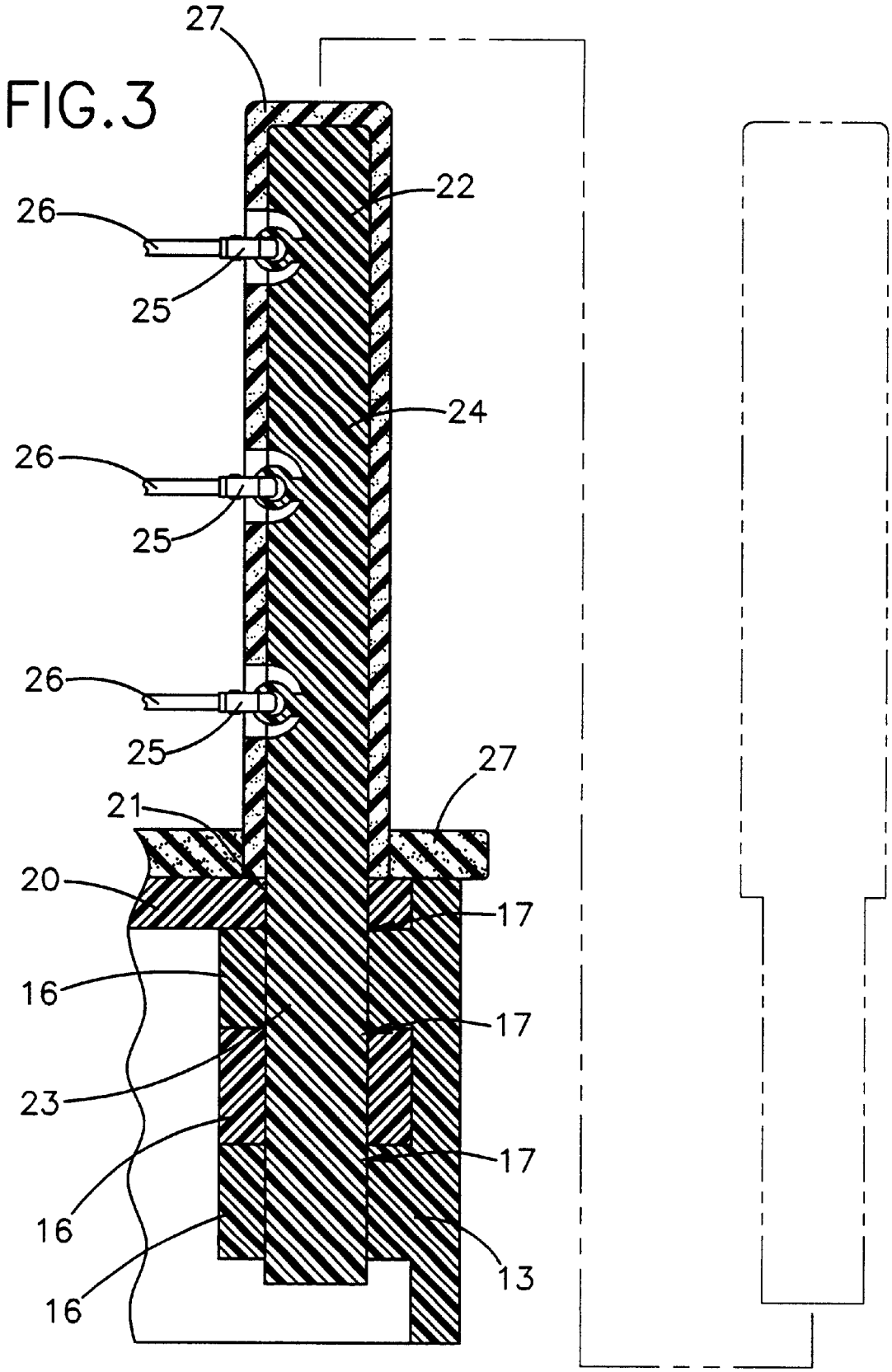
FIG. 3 is a cross-sectional view of a rope support member and a corner and base of the present invention.
Figures 4, 5:
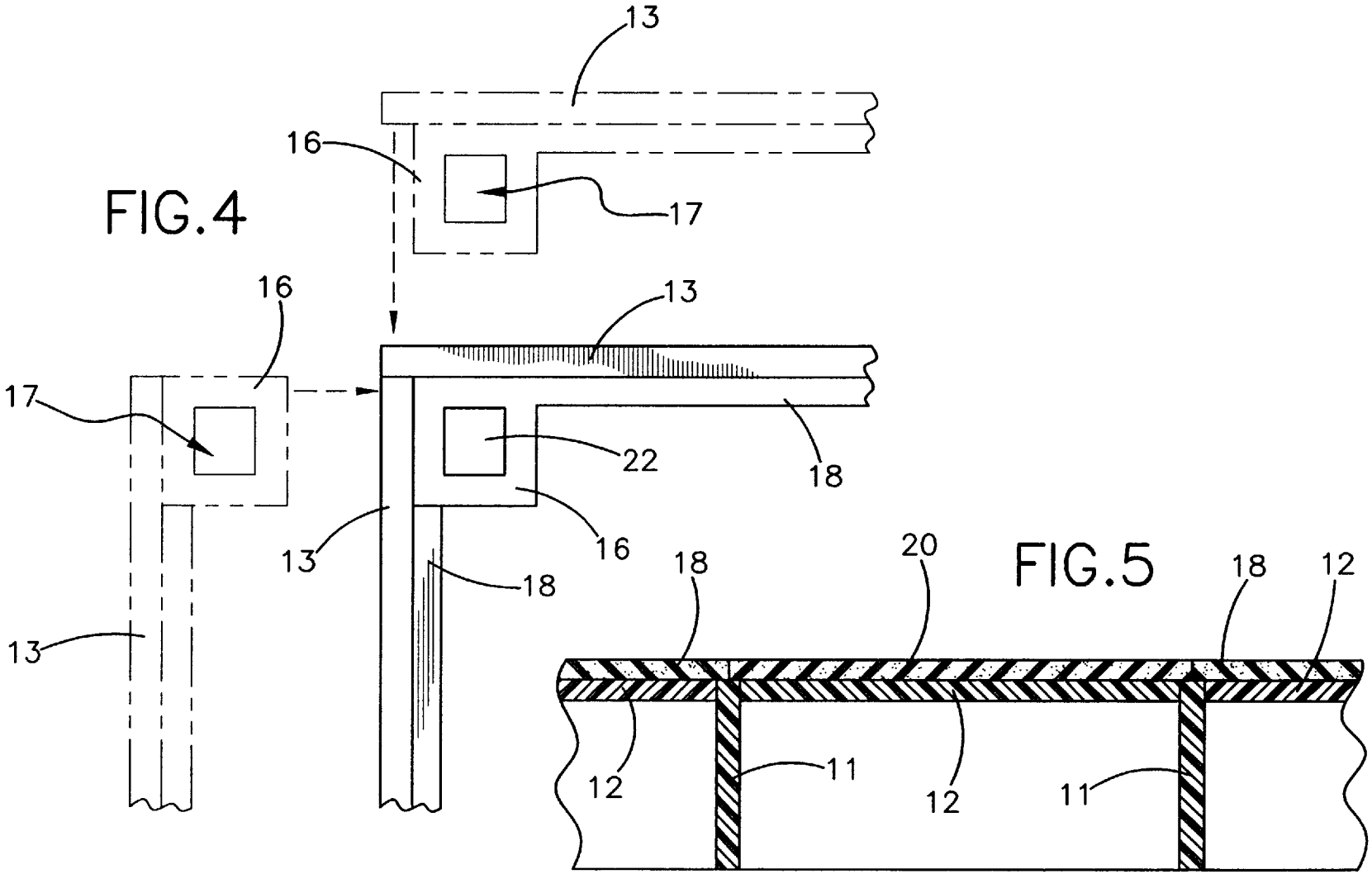
FIG. 4 is a partial top plan view of the present invention.
FIG. 5 is a side elevational view of the deck and base of the present invention.

With reference now to the drawings, and in particular to FIGS. 1 through 5 thereof, a new portable fight ring embodying the principles and concepts of the present invention and generally designated by the reference numeral 10 will be described.

As best illustrated in FIGS. 1 through 5, the portable fight ring 10 generally comprises a base assembly including a plurality of leg members 11 being adapted to rest upon a ground, and also including deck support members 12 being convent onally mounted to the leg members 11 and being adapted to be elevated above the ground, and further including side walls 13 being arranged to form a general square and being interlockingly attached end-to-end. Each of the side walls 13 has finger-like projections 16 being spaced apart and extending outwardly from ends of the side wall 13. The finger-like projections 16 of each of the side walls 13 interlock with the finger-like projections 16 of an adjacent side wall 13. The finger-like projections 16 further have holes 17 extending therethrough. Each of the side walls 13 further has an enlarged upper portion 14 and a recessed portion 15 being disposed in a top of the enlarged upper portion 14 thus forming a ledge 15 upon which a portion of the deck assembly is mounted. The ledge 15 is disposed upon an inner side of the side wall 13 relative to the portable fight ring 10.

A deck assembly is removably mounted upon the base assembly. The deck assembly includes a plurality of panels 18-20 being removably mounted upon the deck support members 12 and upon the side walls 13. The panels 18–20 include a central panel 19, corner panels 18, and side panels 20. The corner panels 18 are interlockingly and conventionally connected to adjacently-disposed side panels 20. The central panel 19 is interlockingly and conventionally connected to the side panels 20. Each of the side and corner panels 19,20 has an outer edge portion which is removably supported upon the ledges 15 of the side walls 13. Each of the corner panels 18 has a hole 21 disposed near a corner thereof. The deck assembly further includes first padding members 27 being securely and conventionally attached to the panels 18–20 with the deck assembly measuring approximately 15 square feet.

Rope support members include posts 22 extending upwardly from the deck assembly for interlocking the base assembly. Each of the posts 22 having a lower portion 23 which is removably received in the holes 21 of the corner panels 18 and the holes 17 of the finger-like projections 16 of the side walls 13 to fasten the side walls 13 together and to fasten the corner panels 18 upon the base assembly. The rope support members also include second padding members 28 being securely and conventionally disposed about the posts 22. The rope support members further includes rope holders 25 being spaced along and securely and conventionally disposed in upper portions 24 of the posts 22.

Rope members 26 are extended between the posts 22 and along a perimeter of the deck assembly. Each of the rope members 26 has ends which are securely and conventionally attached to respective rope holders 25 with the rope members 22 being generally made of a rubberized material.

In use, the user sets up the portable fight ring 10 preferably in one's back yard and the first and second padding members 27, 28 protect the participants from being injured as they can wrestle upon the deck assembly just like the professional wrestlers do.

As to a further discussion of the manner of usage and operation of the present invention, the same should be apparent from the above description. Accordingly, no further discussion relating to the manner of usage and operation will be provided.

With respect to the above description then, it is to be realized hat the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A portable fight ring comprising:

a base assembly;

a deck assembly being removably mounted upon said base assembly;

rope support members including posts extending upwardly from said deck assembly for interlocking said base assembly; and rope members being extended between said posts and along a perimeter of said deck assembly;

wherein said base assembly includes side walls having ends attached together in an interlocking manner, each of said side walls having finger-like projections being spaced apart and extending outwardly from ends of said side wall, said finger-like projections of each of said side walls interlocking with said finger-like projections of an adjacent said side wall, said finger-like projections further having holes extending therethrough.

2. A portable fight ring as described in claim 1, wherein said base assembly includes a plurality of leg members being adapted to rest upon a ground, and also includes deck support members being mounted to said leg members and being adapted to be elevated above the ground.

3. A portable fight ring as described in claim 1, wherein each of said side walls further has an enlarged upper portion and a recessed portion being disposed in a top of said enlarged upper portion thus forming a ledge upon which a portion of said deck assembly is mounted, said ledge being disposed upon an inner side of said side wall relative to said portable fight ring.

4. A portable fight ring as described in claim 1, wherein said deck assembly includes a plurality of panels being removably mounted upon said deck support members and upon said side walls, said panels including a central panel, corner panels, and side panels, said corner panels being interlockingly connected to adjacently-disposed said side panels, said central panel being interlockingly connected to said side panels, each of said side and corner panels having an outer edge portion which is removably supported upon said ledges of said side walls.

5. A portable fight ring as described in claim 4, herein each of said corner panels has a hole disposed near a corner thereof.

6. A portable fight ring as described in claim 5, wherein each of said posts has a lower portion which is removably received in said holes of said corner panels and said holes of said finger-like projections of said side walls to fasten said side walls together and to fasten said corner panels upon said base assembly.

7. A portable fight ring as described in claim 4, wherein said deck assembly further includes first padding members being securely attached to said panels.

8. A portable fight ring as described in claim 1, wherein each of said rope support members also includes second padding members being securely disposed about said posts.

9. A portable fight ring as described in claim 1, wherein said rope support members further includes rope holders being spaced along and disposed in upper portions of said posts.

10. A portable fight ring as described in claim 9, wherein each of said rope members has ends which are securely attached to respective said rope holders, said rope members being generally made of a rubberized material.

11. A portable fight ring comprising:

a base assembly including a plurality of leg members being adapted to rest upon a ground, and also including deck support members being mounted to said leg members and being adapted to be elevated above the ground, and further including side walls being arranged to form a general square and being interlockingly attached end-to-end, each of said side walls having finger-like projections being spaced apart and extending outwardly from ends of said side wall, said finger-like projections of each of said side walls interlocking with said finger-like projections of an adjacent said side wall, said finger-like projections further having holes extending therethrough, each of said side walls further having an enlarged upper portion and a recessed portion being disposed in a top of said enlarged upper portion thus forming a ledge upon which a portion of said deck assembly is mounted, said ledge being disposed upon an inner side of said side wall relative to said portable fight ring;

a deck assembly being removably mounted upon said base assembly, said deck assembly including a plurality of panels being removably mounted upon said deck support members and upon said side walls, said panels including a central panel, corner panels, and side panels, said corner panels being interlockingly connected to adjacently-disposed said side panels, said central panel being interlockingly connected to said side panels, each of said side and corner panels having an outer edge portion which is removably supported upon said ledges of said side walls, each of said corner panels having a hole disposed near a corner thereof, said deck assembly further including first padding members being securely attached to said panels, said deck assembly measuring approximately 15 square feet;

rope support members including posts extending upwardly from said deck assembly for interlocking said base assembly, each of said posts having a lower portion which is removably received in said holes of said corner panels and said holes of said finger-like projections of said side walls to fasten said side walls together and to fasten said corner panels upon said base assembly, said rope support members also including second padding members being securely disposed about said posts, said rope support members further including rope holders being spaced along and securely disposed in upper portions of said posts; and rope members being extended between said posts and along a perimeter of said deck assembly, each of said rope members having ends which are securely attached to respective said rope holders, said rope members being generally made of a rubberized material.

12. A portable fight ring comprising:

a base assembly;

a deck assembly being removably mounted upon said base assembly;

rope support members including posts extending upwardly from said deck assembly for interlocking said base assembly;

rope members being extended between said posts and along a perimeter of said deck assembly;

wherein said base assembly includes a plurality of leg members being adapted to rest upon a ground, and also includes deck support members being mounted to said leg members and being adapted to be elevated above the ground, and further includes side walls being arranged to form a general square and being interlockingly attached end-to-end; and wherein each of said side walls has finger-like projections being spaced apart and extending outwardly from ends of said side wall, said finger-like projections of each of said side walls interlocking with said finger-like projections of an adjacent said side wall, said finger-like projections further having holes extending therethrough.

13. A portable fight ring as described in claim 12, wherein each of said side walls further has an enlarged upper portion and a recessed portion being disposed in a top of said enlarged upper portion thus forming a ledge upon which a portion of said deck assembly is mounted, said ledge being disposed upon an inner side of said side wall relative to said portable fight ring.

14. A portable fight ring as described in claim 13, wherein said deck assembly includes a plurality of panels being removably mounted upon said deck support members and upon said side walls, said panels including a central panel, corner panels, and side panels, said corner panels being interlockingly connected to adjacently-disposed said side panels, said central panel being interlockingly connected to said side panels, each of said side and corner panels having an outer edge portion which is removably supported upon said ledges of said side walls.

15. A portable fight ring as described in claim 14, wherein each of said corner panels has a hole disposed near a corner thereof.

16. A portable fight ring as described in claim 15, wherein each of said posts has a lower portion which is removably received in said holes of said corner panels and said holes of said finger-like projections of said side walls to fasten said side walls together and to fasten said corner panels upon said base assembly.

17. A portable fight ring as described in claim 14, wherein said deck assembly further includes first padding members being attached to said panels.

18. A portable fight ring as described in claim 12, wherein said rope support members also include second padding members being disposed about said posts.

19. A portable fight ring as described in claim 12, wherein said rope support members further includes rope holders being spaced along and disposed in upper portions of said posts.

* * * * *